US006711971B1

(12) United States Patent
Morin

(10) Patent No.: US 6,711,971 B1
(45) Date of Patent: Mar. 30, 2004

(54) ROOFING REMOVAL APPARATUS

(76) Inventor: Guil B. Morin, 3 Florence Ave., Salem, NH (US) 03079

( * ) Notice: Subject to any disclaimer, the term of this patent is extended or adjusted under 35 U.S.C. 154(b) by 115 days.

(21) Appl. No.: 10/071,457

(22) Filed: Feb. 8, 2002

(51) Int. Cl.[7] ..... E04D 15/00
(52) U.S. Cl. ..... 81/45; 81/46; 30/170
(58) Field of Search ..... 81/45, 46; 30/169, 30/170; 229/41.1, 36.1, 39, 37

(56) References Cited

U.S. PATENT DOCUMENTS

| | | | | | |
|---|---|---|---|---|---|
| 3,542,433 | A | | 11/1970 | Probst | |
| 3,695,713 | A | | 10/1972 | Rothi et al. | |
| 4,091,535 | A | * | 5/1978 | Lehrter | 30/169 |
| 4,277,104 | A | | 7/1981 | Sanchez | |
| 4,699,430 | A | * | 10/1987 | Nichols | 299/37.1 |
| 4,709,479 | A | | 12/1987 | Lavelette | |
| 4,837,933 | A | * | 6/1989 | Chapman | 30/170 |
| D332,270 | S | | 1/1993 | Hefty | |
| 5,218,766 | A | * | 6/1993 | Himebaugh | 30/170 |
| 5,741,047 | A | | 4/1998 | Ordonez | |
| 5,921,155 | A | * | 7/1999 | Faller et al. | 81/45 |
| 6,095,015 | A | * | 8/2000 | Phelan | 81/45 |
| 6,116,117 | A | * | 9/2000 | Nicolosi et al. | 81/45 |

* cited by examiner

*Primary Examiner*—Joseph J. Hail, III
*Assistant Examiner*—David B. Thomas

(57) ABSTRACT

Disclosed is a roofing removal apparatus for removing existing shingles from a roof. The apparatus includes an elongate base member that has a front end and a back end. A frame is mounted on the base member, and a power source is secured to the frame. A pair of wheels are rotatable coupled to sides of the base member. An elongate upper member for separating the shingles from the roof is positioned on top of the base member. The upper member has a forward end and a rearward end. A pivot coupler is positioned between the upper member and the base member. A cam member is attached to the power source. A coupling member couples the upper member to the power source. A guard protects the power source from debris. A handle member for allows a user to control movement of the base member, and a control assembly for controls the power source.

21 Claims, 3 Drawing Sheets

ROOFING REMOVAL APPARATUS

BACKGROUND OF THE INVENTION

1. Field of the Invention

The present invention relates to roofing removal tools and more particularly pertains to a new roofing removal apparatus for removing existing shingles from a roof.

2. Description of the Prior Art

The use of roofing removal tools is known in the prior art. U.S. Pat. No. 3,695,713 describes a roofing removal process and machine. Another type of roofing removal tool is U.S. Pat. No. 3,542,433 having a small tractor and a roof removing attachment that extend forwardly of the tractor.

SUMMARY OF THE INVENTION

The present invention generally comprises an elongate base member that has a front end and a back end. A frame is mounted on the base member, and a power source is secured to the frame. A pair of wheels are rotatably coupled to sides of the base member. An elongate upper member for separating the shingles from the roof is positioned on top of the base member. The upper member has a forward end and a rearward end. A pivot coupler is positioned between the upper member and the base member. A cam member is attached to the power source. A coupling member couples the upper member to the power source. A guard protects the power source from debris. A handle member for allows a user to control movement of the base member, and a control assembly for controls the power source.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
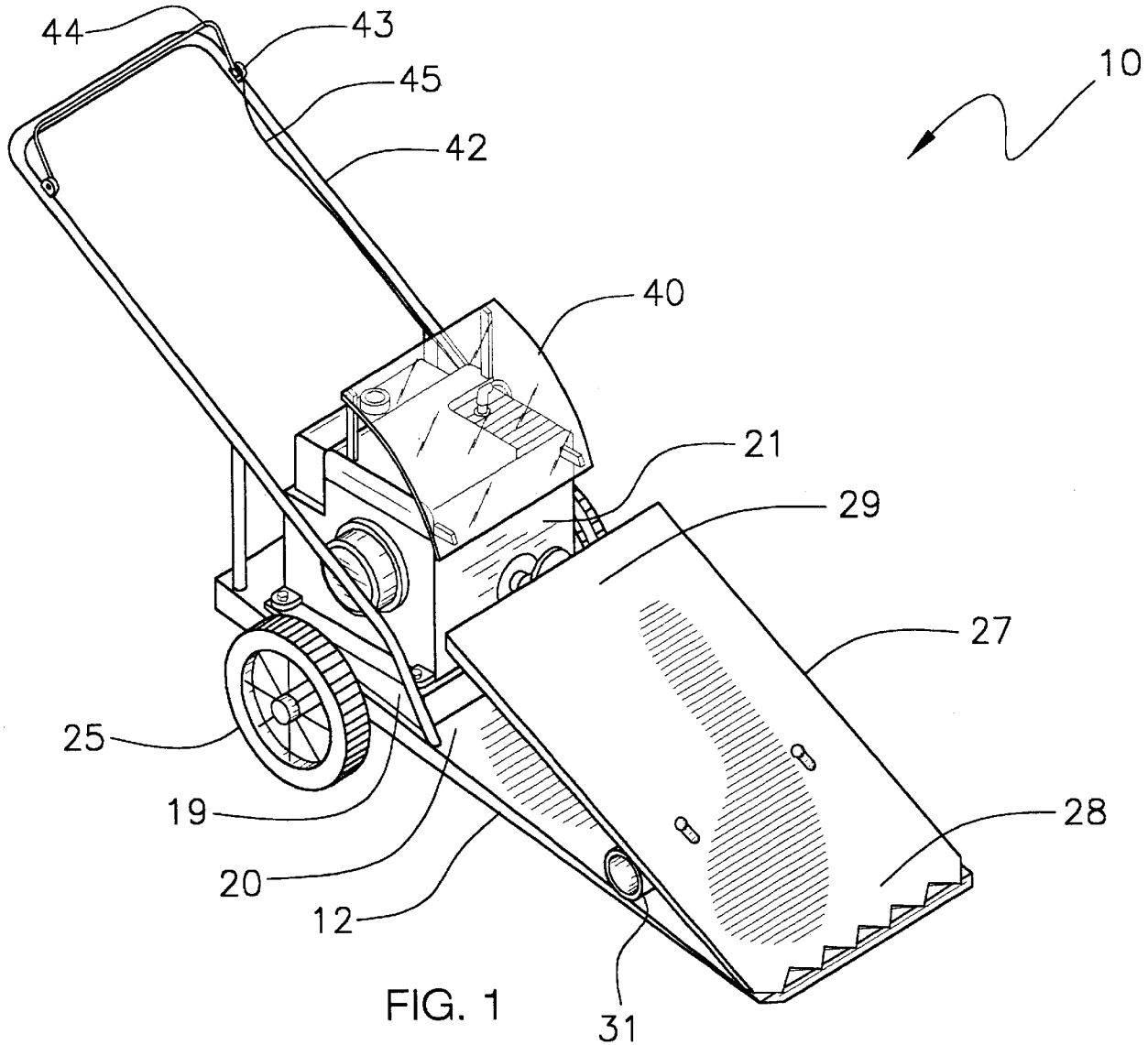
FIG. 1 is a schematic perspective view of a new roofing removal apparatus according to the present invention.
Figure 2:
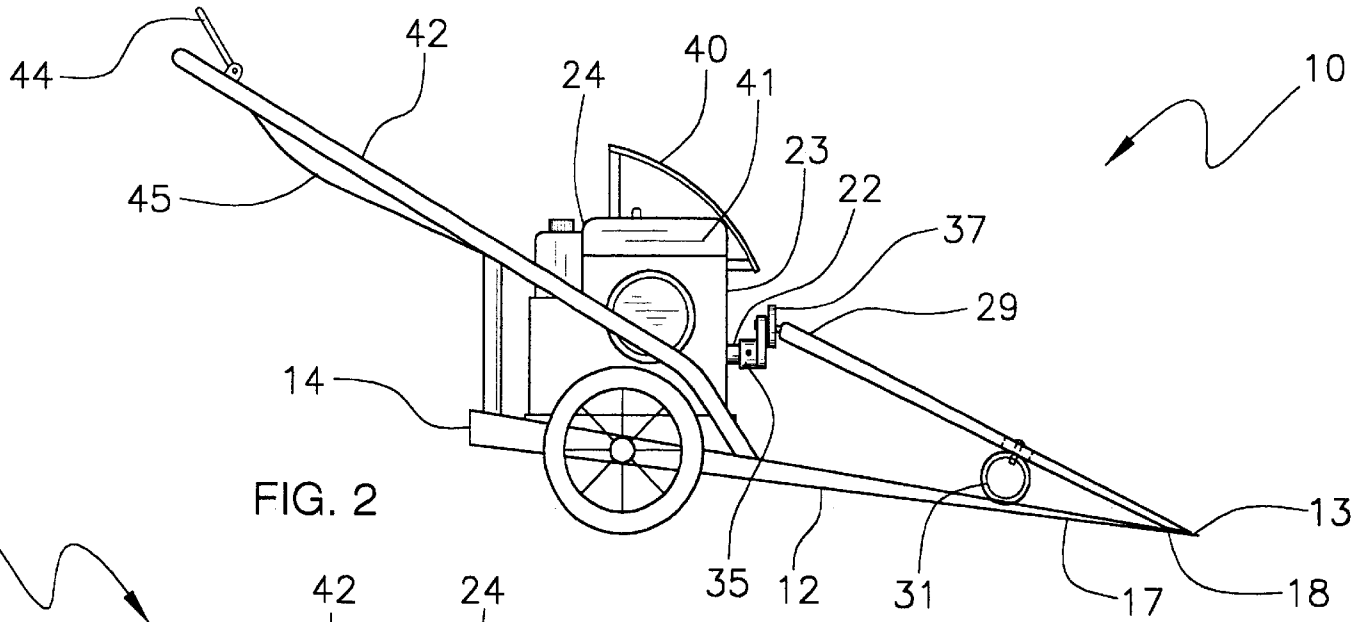
FIG. 2 is a schematic side view of the present invention.
Figure 3:
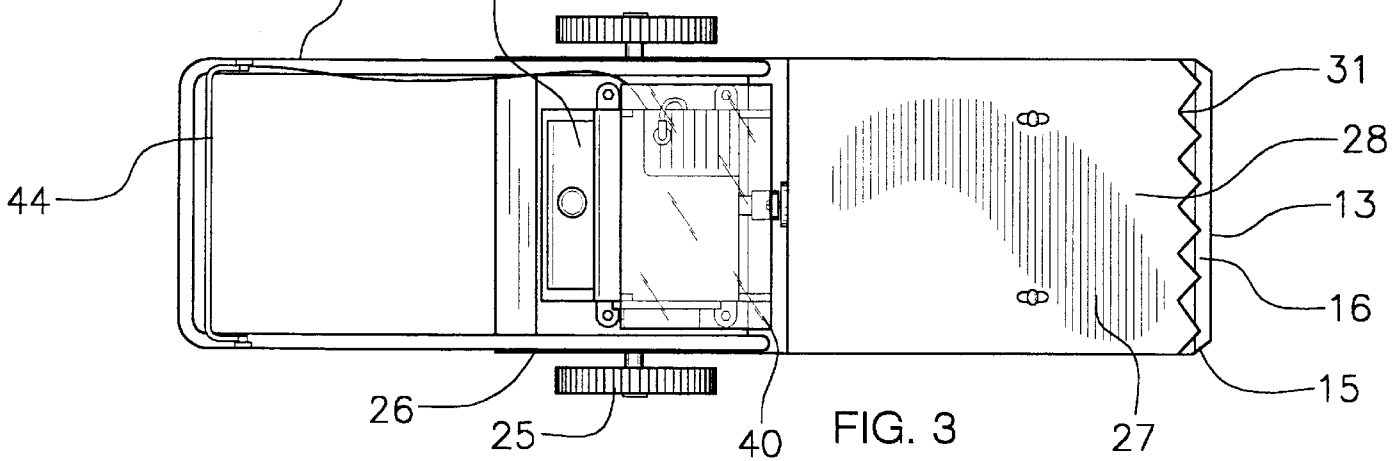
FIG. 3 is a schematic top view of the present invention.
Figure 4:
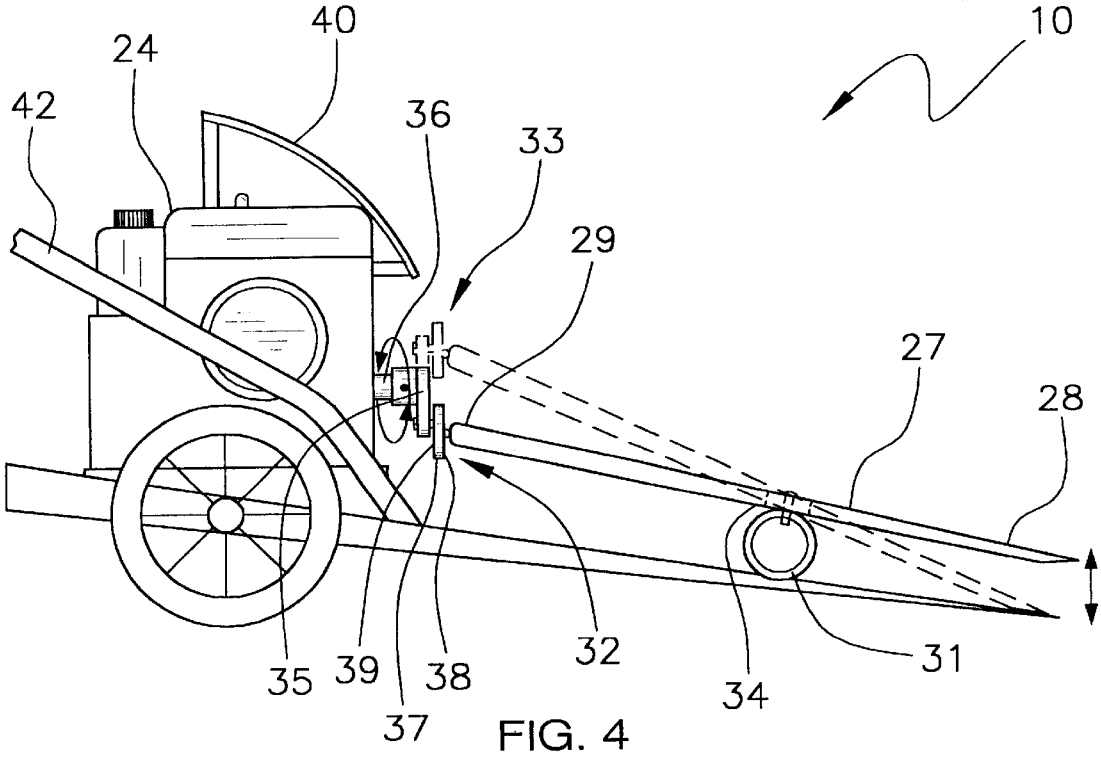
FIG. 4 is a schematic side view of the present invention depicted in different positions.
Figure 5:
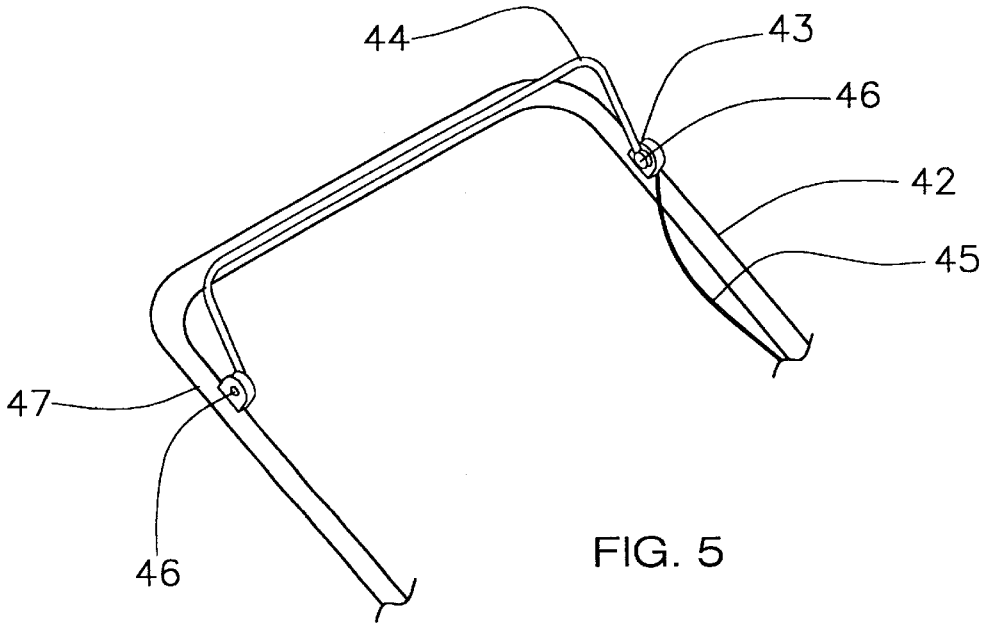
FIG. 5 is a schematic perspective view of the handle of the present invention.

With reference now to the drawings, and in particular to FIGS. 1 through 5 thereof, a new roofing removal apparatus embodying the principles and concepts of the present invention and generally designated by the reference numeral 10 will be described.

As best illustrated in FIGS. 1 through 5, the roofing removal apparatus 10 generally comprises an elongate base member 12 that has a front end 13 and a back end 14. A top front corner 15 of the front end 13 of the base member 12 is beveled. The front end 13 of the base member 12 forms a blade section 16 across a width of the base member 12.

A bottom surface 17 of the base member 12 has a substantially flat portion 18 positioned adjacent to the front end 13 for abutting the roof such that the front end 13 is positionable between the shingles and the roof. A thickness of the back end 14 of the base member 12 is generally greater than a thickness of the front end 13 such that the base member 12 is generally wedge-shaped.

A frame 19 is fixedly coupled to a top surface 20 of the base member 12 and positioned adjacent to the back end 14.

A power source 21 is mounted on the frame 19. The power source 21 includes a rotatable drive shaft 22 that extends outward from a front side 23 of the power source 21. The power source 21 comprises a gas engine 24.

A pair of wheels 25 are rotatably coupled to sides 26 of the base member 12. Each of the wheels 25 is positioned nearer to the back end 14 than the front end 13. Each of the wheels 25 extends away from the base member 12 such that the back end 14 of the base member 12 is supported by the wheels 25.

An elongate upper member 27 for separating the shingles from the roof has a forward end 28 and a rearward end 29. The forward end 28 of the upper member 27 is positionable adjacent to the blade section 16 of the base member 12. The forward end 28 of the upper member 27 has a plurality of triangular cutouts 20 extending across a width of the upper member 27. The width of the upper member 27 is generally equal to the width of the base member 12. A thickness of the rearward end 29 of the upper member 27 is generally greater than a thickness of the forward end 28 such that the upper member 27 is wedge-shaped.

A pivot coupler 31 is positioned between the upper member 27 and the base member 12. The pivot coupler 31 acts as a fulcrum causing the forward end 28 of the upper member 27 to oscillate upward and downward when the rearward end 29 oscillates between a lower position 32 and an upper position33 respectively. A longitudinal axis of the pivot coupler 31 is oriented substantially perpendicular to a longitudinal axis of the base member 12. The pivot coupler 31 is located nearer the front end 13 of the base member 12 than the back end 14. A bottom side 34 of the upper member 27 abuts the pivot coupler 31 and the forward end 28 abuts the base member 12 when the rearward end 29 of the upper member 27 is in the upper position 33.

A cam member 35 is attached to the power source 21. The cam member 35 is positioned adjacent to an outer end 36 of the drive shaft 22 of the power source 21.

A coupling member 37 couples the upper member 27 to the power source 21. An outer side 38 of the coupling member 37 is hingably coupled to the rearward end 29 of the upper member 27. An inner side 39 of the coupling member 37 is rotatably coupled to the cam member 35 such that the rearward end 29 of the upper member 27 oscillates between the upper position 33 and the lower position 32 when the cam member 35 rotates.

A guard 40 protects the power source 21. The guard 40 is mounted to an upper forward portion 41 of the power source 21.

A handle member 42 for allowing a user to control movement of the base member 12 is fixedly coupled to and extends upward and rearward from the back end 14 of the base member 12. The handle member 42 is generally U-shaped.

A control assembly 43 controls the power source 21 and comprises a control lever 44 and a control cable 45. Ends 46 of the control lever 44 are pivotally coupled to an uppermost portion 47 of the handle member 42. The control cable 45 is attached to and extends between the control lever 44 and the power source 21. The control cable 45 is pulled taut when the control lever 44 is pivoted fully downward onto the handle such that the power source 21 is enabled.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A roofing removal apparatus for removing existing shingles from a roof, said apparatus comprising:

an elongate base member having a front end and a back end;

a frame;

a power source being mounted on said frame;

a pair of wheels being rotatably coupled to sides of said base member;

an elongate upper member for separating the shingles from the roof, said upper member having a forward end and a rearward end;

a pivot coupler being positioned between said upper member and said base member;

a cam member being attached to said power source;

a coupling member for coupling said upper member to said power source;

a guard for protecting said power source;

a handle member for allowing a user to control movement of said base member;

a control assembly for controlling said power source;

said power source including a rotatable drive shaft extending outwardly from a front side of said power source, said power source comprising a gas engine; and said cam member being positioned adjacent to an outer end of said drive shaft of said power source.

2. The roofing removal apparatus as set forth in claim 1, further comprising a top front corner of said front end of said base member being beveled, said front end of said base member forming a blade section across a width of said base member.

3. The roofing removal apparatus as set forth in claim 1, wherein a bottom surface of said base member has a substantially flat portion positioned adjacent to said front end for abutting the roof such that said front end is positionable between the shingles and the roof.

4. The roofing removal apparatus as set forth in claim 1, further comprising a thickness of said back end of said base member being generally greater than a thickness of said front end such that said base member is generally wedge-shaped.

5. The roofing removal apparatus as set forth in claim 1, further comprising said frame being fixedly coupled to a top surface of said base member and positioned adjacent to said back end.

6. The roofing removal apparatus as set forth in claim 1, further comprising each of said wheels being positioned nearer to said back end than said front end, each of said wheels extending away from said base member such that said back end of said base member is supported by said wheels.

7. The roofing removal apparatus as set forth in claim 2, further comprising said forward end of said upper member being positionable adjacent to said blade section of said base member.

8. The roofing removal apparatus as set forth in claim 1, further comprising said forward end of said upper member having a plurality of triangular cutouts extending across a width of said upper member.

9. The roofing removal apparatus as set forth in claim 8, further comprising a width of said upper member being generally equal to the width of said base member.

10. The roofing removal apparatus as set forth in claim 1, further comprising a thickness of said rearward end of said upper member being generally greater than a thickness of said forward end such that said upper member is wedge-shaped.

11. The roofing removal apparatus as set forth in claim 1, wherein said pivot coupler acts as a fulcrum causing said forward end of said upper member to oscillate upward and downward when said rearward end oscillates between a lower position and an upper position respectively, a longitudinal axis of said pivot coupler being oriented substantially perpendicular to a longitudinal axis of said base member.

12. The roofing removal apparatus as set forth in claim 11, further comprising said pivot coupler being located nearer said front end of said base member than said back end, a bottom side of said upper member abuts said pivot coupler and said forward end abuts said base member when said rearward end of said upper member is in said upper position.

13. The roofing removal apparatus as set forth in claim 11, further comprising an outer side of said coupling member being hingably coupled to said rearward end of said upper member, an inner side of said coupling member being rotatably coupled to said cam member such that said rearward end of said upper member oscillates between said upper position and said lower position when said cam member rotates.

14. The roofing removal apparatus as set forth in claim 1, further comprising said guard being mounted to an upper forward portion of said power source.

15. The roofing removal apparatus as set forth in claim 1, further comprising said handle member being fixedly coupled to and extending upwardly and rearwardly from said back end of said base member, said handle member being generally U-shaped.

16. The roofing removal apparatus as set forth in claim 1, further comprising said control assembly comprising a control lever and a control cable, ends of said control lever being pivotally coupled to an uppermost portion of said handle, said control cable being attached to and extending between said control lever and said power source.

17. The roofing removal apparatus as set forth in claim 16, wherein said control cable is pulled taut when said control lever is pivoted fully downward onto said handle such that said power source is enabled.

18. The roofing removal apparatus as set forth in claim 1, further comprising:

said elongate base member having a top front corner of said front end of said base member being beveled, said front end of said base member forming a blade section across a width of said base member, wherein a bottom surface of said base member has a substantially flat portion positioned adjacent to said front end for abutting the roof such that said front end is positionable between the shingles and the roof, a thickness of said back end of said base member being generally greater than a thickness of said front end such that said base member is generally wedge-shaped;

said frame being fixedly coupled to a top surface of said base member and positioned adjacent to said back end;

each of said wheels being positioned nearer to said back end than said front end, each of said wheels extending away from said base member such that said back end of said base member is supported by said wheels;

said forward end of said upper member being positionable adjacent to said blade section of said base member, said forward end of said upper member having a plurality of triangular cutouts extending across a width of said upper member, the width of said upper member being generally equal to the width of said base member, a thickness of said rearward end of said upper member being generally greater than a thickness of said forward end such that said upper member is wedge-shaped;

wherein said pivot coupler acts as a fulcrum causing said forward end of said upper member to oscillate upward and downward when said rearward end oscillates between a lower position and an upper position respectively, a longitudinal axis of said pivot coupler being oriented substantially perpendicular to a longitudinal axis of said base member, said pivot coupler being located nearer said front end of said base member than said back end, a bottom side of said upper member abuts said pivot coupler and said forward end abuts said base member when said rearward end of said upper member is in said upper position;

an outer side of said coupling member being hingably coupled to said rearward end of said upper member, an inner side of said coupling member being rotatably coupled to said cam member such that said rearward end of said upper member oscillates between said upper position and said lower position when said cam member rotates;

said guard being mounted to an upper forward portion of said power source;

said handle member being fixedly coupled to and extending upwardly and rearwardly from said back end of said base member, said handle member being generally U-shaped; and said control assembly comprising a control lever and a control cable, ends of said control lever being pivotally coupled to an uppermost portion of said handle, said control cable being attached to and extending between said control lever and said power source, wherein said control cable is pulled taut when said control lever is pivoted fully downward onto said handle such that said power source is enabled.

19. A roofing removal apparatus for removing existing shingles from a roof, said apparatus comprising:

an elongate base member having a front end and a back end;

a frame;

a power source being mounted on said frame;

a pair of wheels being rotatably coupled to sides of said base member;

an elongate upper member for separating the shingles from the roof, said upper member having a forward end and a rearward end;

a pivot coupler being positioned between said upper member and said base member;

a cam member being attached to said power source;

a coupling member for coupling said upper member to said power source;

a guard for protecting said power source;

a handle member for allowing a user to control movement of said base member;

a control assembly for controlling said power source; and said frame being fixedly coupled to a top surface of said base member and positioned adjacent to said back end.

20. A roofing removal apparatus for removing existing shingles from a roof, said apparatus comprising:

an elongate base member having a front end and a back end;

a frame;

a power source being mounted on said frame;

a pair of wheels being rotatably coupled to sides of said base member;

an elongate upper member for separating the shingles from the roof, said upper member having a forward end and a rearward end;

a pivot coupler being positioned between said upper member and said base member;

a cam member being attached to said power source;

a coupling member for coupling said upper member to said power source;

a guard for protecting said power source;

a handle member for allowing a user to control movement of said base member;

a control assembly for controlling said power source; and said pivot coupler acts as a fulcrum causing said forward end of said upper member to oscillate upward and downward when said rearward end oscillates between a lower position and an upper position respectively, a longitudinal axis of said pivot coupler being oriented substantially perpendicular to a longitudinal axis of said base member.

21. A roofing removal apparatus for removing existing shingles from a roof, said apparatus comprising:

an elongate base member having a front end and a back end;

a frame;

a power source being mounted on said frame;

a pair of wheels being rotatably coupled to sides of said base member;

an elongate upper member for separating the shingles from the roof, said upper member having a forward end and a rearward end;

a pivot coupler being positioned between said upper member and said base member;

a cam member being attached to said power source;

a coupling member for coupling said upper member to said power source;

a guard for protecting said power source;

a handle member for allowing a user to control movement of said base member;

a control assembly for controlling said power source; and said guard being mounted to an upper forward portion of said power source.

* * * * *